US007462202B2

(12) United States Patent
Kaplan et al.

(10) Patent No.: US 7,462,202 B2
(45) Date of Patent: Dec. 9, 2008

(54) METHOD TO REMOVE FOXING STAINS FROM PAPER & CELLULOID ITEMS

(76) Inventors: Jeffrey Lee Kaplan, P.O. Box 11106, Ft. Lauderdale, FL (US) 33339; Robert Namiat, 6185-A Live Oak Ct., Tamarac, FL (US) 33319

( * ) Notice: Subject to any disclaimer, the term of this patent is extended or adjusted under 35 U.S.C. 154(b) by 491 days.

(21) Appl. No.: 11/188,814

(22) Filed: Jul. 26, 2005

(65) Prior Publication Data

US 2007/0022542 A1 Feb. 1, 2007

(51) Int. Cl.
*D06L 3/06* (2006.01)
*D06L 3/14* (2006.01)

(52) U.S. Cl. ..... 8/109; 8/133; 8/147

(58) Field of Classification Search ..... 8/108.1, 8/109, 111, 133, 147, 150, 158
See application file for complete search history.

(56) References Cited

U.S. PATENT DOCUMENTS 3,318,657 A * 5/1967 Wade ..... 8/111
4,410,566 A * 10/1983 Mills ..... 427/161
6,242,409 B1 * 6/2001 Appel et al. ..... 510/376

* cited by examiner

*Primary Examiner*—Joseph L Perrin

(57) ABSTRACT

A method to safely remove foxing stains from paper and celluloid items using distilled water, sodium hypochlorite, acetic acid, sodium bicarbonate and glue size.

1 Claim, No Drawings

METHOD TO REMOVE FOXING STAINS FROM PAPER & CELLULOID ITEMS

BACKGROUND-FIELD OF INVENTION

This invention relates to a novel method comprising a mixture of liquid or powdered sodium hypochlorite (bleach), distilled H2O (water), acedic acid (vinegar), sodium bicarbonated (baking soda) and Glue Size which will remove foxing stains from paper and celluloid items.

DISCUSSION OF PRIOR ART

Foxing is a pattern of spotting or speckling stains that mar many archival works found in old books, vintage paper or sometimes cloth, usually brown or yellowish brown in tone and often more or less circular in shape. Its cause is not fully understood but generally it is believed a slow process caused by fungal or mold microorganisms enabled by impurities in paper and storage conditions that are damp and warm enough to facilitate the process.

Filamentous fungi are known to damage and destroy paper and celluloid items in two principal ways. First, they utilize the paper cellulose as a carbon source, weakening and eventually destroying the paper fibers. Fungi also live on the trace metals found in paper or often in the inks on the paper.

Four strains of fungi are commonly found to cause foxing and each fungi is characterized by the production of different colored stains. Fungus *Alternaria Solani* produces a dense black stain, *Fusarium Oxysporum*, a pinkish stain, *Penicillium Notatum*, a light green stain and *Chaetomium Globosum*, a brownish grey stain.

These stains can sometimes be extracted with harsh solvents but there are few effective solvents that do not dissolve the ink or damage the paper fibers and many stains resist solvent extraction effectively. Treatment for foxing is difficult at best and often simply impractical.

Developing new solvent systems is time consuming and requires a great deal of trial and error, since the chemical structure of the pigment stains is not generally known.

Mechanical stain removal is also problematic in that it is not selective between ink and stain; often produces abrasion of the paper fibers, markedly deteriorating the paper; and is extraordinarily tedious, thus an inexpensive safe and effective method is needed to remove foxing stains and is in great demand.

The use of unsafe and damaging treatments to remove foxing stains is well established in the art of restoration and conservation. Typical topical chemicals used in the art are Ethylene Oxide (also known as EO, EtO, ETO, anprolene, dihydrooxirene, 1,2-epoxyethane, oxacyclopropane, oxane, oxidoethane an oxirane), sodium hypochlorite (household bleach), Chloramine-T, Calcium Hypochlorite, Chloramine Gas, Hydrogen Peroxide, Sodium Borohydride, Chlorine Dioxide, Chlorhexidine Gluconate, Magnesium Oxide, Potassium Permanganate and Lithium Aluminum Hydride.

All of these dangerous chemicals seriously degrade the cellulose in the paper and may lead to wrinkling of pages or bleeding of text or illustrations. These chemicals when used also introduce acidic residue salts that will contribute to additional damage in time and are difficult to use and quite expensive to purchase.

Some typical foxing removal procedures and guidelines found in the art are as follows:

a) Timothy Barrett, Japanese Papermaking, Tokyo & New York: Weatherhill;

b) Anne F. Clapp, Curatorial Care of Works of Art on paper. New York: Nick Lyons Books, 1987 c) Carl Schraubstadter, Care and Repair of Japanese Prints, Cornwall: Idlewild, 1948

To remove foxing stains by bleaching, Schraubstadter recommends chlorine bleach or what is the same, common household bleach (sodium hypoclorite) which is extremely alkaline and therefore easily damages the paper fibers. Furthermore, if not rinsed sufficiently, chemical residues remain on the paper, causing future damage and decomposition.

Further bleaching methods published in the art are with Chloramine-T, Sodium Peroxide or Sodium Borohydride in water with Lithium Aluminum Hydride in non-aqueous solvents. Another published bleaching method is to use commercial grade Hydrogen Peroxide. The Hydrogen Peroxide can be diluted in a ration of 1:1 or more. After applying the Hydrogen Peroxide the paper must be washed in a solution of Calcium Hydroxide mixed in distilled water. This agent supposedly removes traces of acidic substances from the paper or celluloid item.

Unfortunately, these methods and formulations as well as others have many disadvantages such as toxicity, flammability and are expensive. They are also shown to damage the paper for which they were intended to save. Thus, a need exists for an inexpensive, safe and reliable method that is specifically designed to control and remove the unique problems associated with foxing stains on paper and celluloid items.

OBJECTS AND ADVANTAGES

Accordingly, several objects and advantages of our invention are:

a) to provide a novel method designed to control and remove foxing stains from paper and celluloid items.

b) to provide a novel method designed not to harm or destroy the paper or celluloid item, text or artwork on the paper or celluloid items while controlling or removing the foxing stains.

c) to provide a novel method that control and removes foxing stains and leaves no residue which will harm the paper or cellulose items.

d) to provide a novel method that is safe to use by humans while applying it to paper and celluloid items.

e) to provide a novel method that is low cost to manufacture and to use.

DETAILED DESCRIPTION OF THE INVENTION

In the present invention, the foregoing difficulties are obviated in that there are a provided a low cost, easily dispersed method consisting of inexpensive commercially available ingredients including the purchasing of conventional trays which would be easily understood by one having ordinary skill in the art. In accordance with the invention, the method is as follows:

1) Soak the paper or celluloid item completely in a warm bath of distilled water;

2) Remove the paper or celluloid item and blot all excess water;

3) Soak the paper or celluloid item completely in a warm bath of household bleach, less than 5% concentration;

4) Soak and rinse the paper or celluloid item completely with warm distilled water;

5) Remove the paper or celluloid item and blot all excess water;

6) Soak the paper or celluloid item completely in a warm bath of vinegar, no less than 75% concentration;
7) Soak and rinse the paper or celluloid completely item in a bath of cold distilled water;
8) Remove the paper or celluloid item and blot all excess water;
9) Soak the paper or celluloid item completely in a bath of sodium bicarbonate (baking soda) and distilled water;
10) Soak and rinse the paper or celluloid item completely with distilled room temperature water;
11) Remove the paper or celluloid item and blot all excess water;
12) Soak the paper or celluloid item completely in a bath of glue size.
13) Soak and rinse the paper or celluloid item completely in a bath of cold distilled water;
14) Remove the paper or celluloid item and blot all excess water.
15) Air Dry the paper or celluloid item without the use of a heat blower.

CONCLUSION, RAMIFICATION AND SCOPE OF THE INVENTION

Accordingly, the reader will see that this intricate detailed step method of removing foxing stains provides that:

It will specifically control and kill the growth of filamentous fungi and mold microorganisms that attack paper and celluloid items:

It will not harm or destroy the paper or celluloid items:

It will not leave a harmful residue or film on the paper or celluloid items:

It will not harm humans while being applied to paper and celluloid items:

It will be a low cost archival method to conserve and protect valuable paper and celluloid items.

Those skilled in the art will have no difficulty in determining suitable proportions of the above method to be used. The invention has been described as applied to preferred embodiments and it will be understood that various substitutions and changes may be effected without departing from the spirit and scope of the novel concepts and principals of this invention.

We claim:

1. A method of removing foxing stains from paper and celluloid items comprising the steps of:

(a) soaking the paper or celluloid item completely in a warm bath of distilled water in soaking utensils which are conventional trays which can be purchased and easily understood by one having ordinary skill in the art; and (b) removing the paper or celluloid item and blotting all excess water; and (c) soaking the paper or celluloid item completely in a warm bath of sodium hypochlorite also commonly known as household bleach with less than five percent concentration (5%) in soaking utensils which are conventional trays which can be purchased and easily understood by one having ordinary skill in the art; and (d) soaking and rinsing the paper or celluloid item completely in a warm bath of distilled water in soaking utensils which are conventional trays which can be purchased and easily understood by one having ordinary skill in the art; and (e) removing the paper or celluloid item and blotting all excess water, and (f) soaking the paper or celluloid item completely in a warm bath of acetic acid also commonly known as vinegar of no less than seventy-five percent concentration (75%); and (g) soaking the paper or celluloid item completely in a bath of cold distilled water in soaking utensils which are conventional trays which can be purchased and easily understood by one having ordinary skill in the art; and (h) removing the paper or celluloid item and blotting all excess water; and (i) soaking the paper or celluloid item completely in bath of sodium bicarbonate also commonly known as baking soda and distilled water in soaking utensils which are conventional trays which can be purchased and easily understood by one having ordinary skill in the art; and (j) soaking and rinsing the paper or celluloid item completely with distilled room temperature water in soaking utensils which are conventional trays which can be purchased and easily understood by one having ordinary skill in the art; and (k) removing the paper or celluloid item and blotting all excess water; and (l) soaking the paper or celluloid item completely in bath of glue size in soaking utensils which are conventional trays which can be purchased and easily understood by one having ordinary skill in the art; and (m) soaking and rinsing the paper or celluloid item completely in a bath of cold distilled water in soaking utensils which are conventional trays which can be purchased and easily understood by one having ordinary skill in the art; and (n) removing the paper or celluloid item and blotting all excess water; and (o) air drying the paper or celluloid item without the use of a heat blower.

* * * * *